US009303496B2

(12) United States Patent
Xiao et al.

(10) Patent No.: US 9,303,496 B2
(45) Date of Patent: Apr. 5, 2016

(54) SUBMERSIBLE PUMP SYSTEMS AND METHODS

(71) Applicant: Saudi Arabian Oil Company, Dhahran (SA)

(72) Inventors: Jinjiang Xiao, Dhahran (SA); Randall Alan Shepler, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 414 days.

(21) Appl. No.: 13/867,607

(22) Filed: Apr. 22, 2013

(65) Prior Publication Data

US 2013/0277064 A1 Oct. 24, 2013

Related U.S. Application Data

(60) Provisional application No. 61/635,954, filed on Apr. 20, 2012.

(51) Int. Cl.
*E21B 43/12* (2006.01)
*E21B 23/12* (2006.01)

(52) U.S. Cl.
CPC ..... *E21B 43/128* (2013.01); *E21B 23/002* (2013.01); *E21B 43/129* (2013.01)

(58) Field of Classification Search
CPC ..... E21B 43/128; E21B 23/002
See application file for complete search history.

(56) References Cited

U.S. PATENT DOCUMENTS

| | | | |
|---|---|---|---|
| 4,798,247 | A | 1/1989 | Deaton et al. |
| 5,099,919 | A | 3/1992 | Schneider et al. |
| 5,252,224 | A | 10/1993 | Modell et al. |
| 5,971,072 | A | 10/1999 | Huber et al. |
| 5,975,209 | A | 11/1999 | McCorry |
| 6,497,278 | B1 | 12/2002 | Norris |
| 6,543,541 | B2 | 4/2003 | Buyers et al. |

(Continued)

FOREIGN PATENT DOCUMENTS

| | | | |
|---|---|---|---|
| GB | 2 288 197 | A | 10/1995 |
| WO | 02/075111 | A1 | 9/2002 |
| WO | 2008/102170 | A1 | 8/2008 |

OTHER PUBLICATIONS

PCT International Search Report and the Written Opinion of the International Searching Authority dated Jun. 4, 2014; International Application No. PCT/US2013/037272; International File Date: Apr. 19, 2013.

*Primary Examiner* — David Andrews
(74) *Attorney, Agent, or Firm* — Bracewell LLP; Constance Gall Rhebergen; Keith R. Derrington

(57) ABSTRACT

A submersible pump system that is operable to permit selective access into a production zone of a well bore while a submersible pumping device is operating includes a Y-tool, a submersible pumping device, a control valve assembly and a power conduit. The control valve assembly is also operable to selectively permit access between the interior of the submersible pumping system and the exterior of the submersible pumping system. The valve is operable to form a dynamic seal. The power conduit is operable to convey both power and a pre-designated control signal simultaneously. A method for accessing the production zone of the well bore with a well bore tool uses the submersible pump system while the submersible pump system is producing production zone fluid. The submersible pumping device continues to operate without interruption after transmission of the pre-designated pump control signal.

19 Claims, 3 Drawing Sheets

(56) References Cited

U.S. PATENT DOCUMENTS

| | | | |
|---|---|---|---|
| 6,887,369 | B2 | 5/2005 | Moulton et al. |
| 7,048,057 | B2 | 5/2006 | Bearden et al. |
| 7,231,978 | B2 | 6/2007 | Rivas et al. |
| 7,363,983 | B2 | 4/2008 | Martinez et al. |
| 7,730,937 | B2 | 6/2010 | Head |
| 7,819,184 | B2 | 10/2010 | Sachdeva et al. |
| 2006/0231256 | A1 | 10/2006 | Rivas et al. |
| 2009/0200034 | A1 | 8/2009 | Leitch |

Fig. 2A
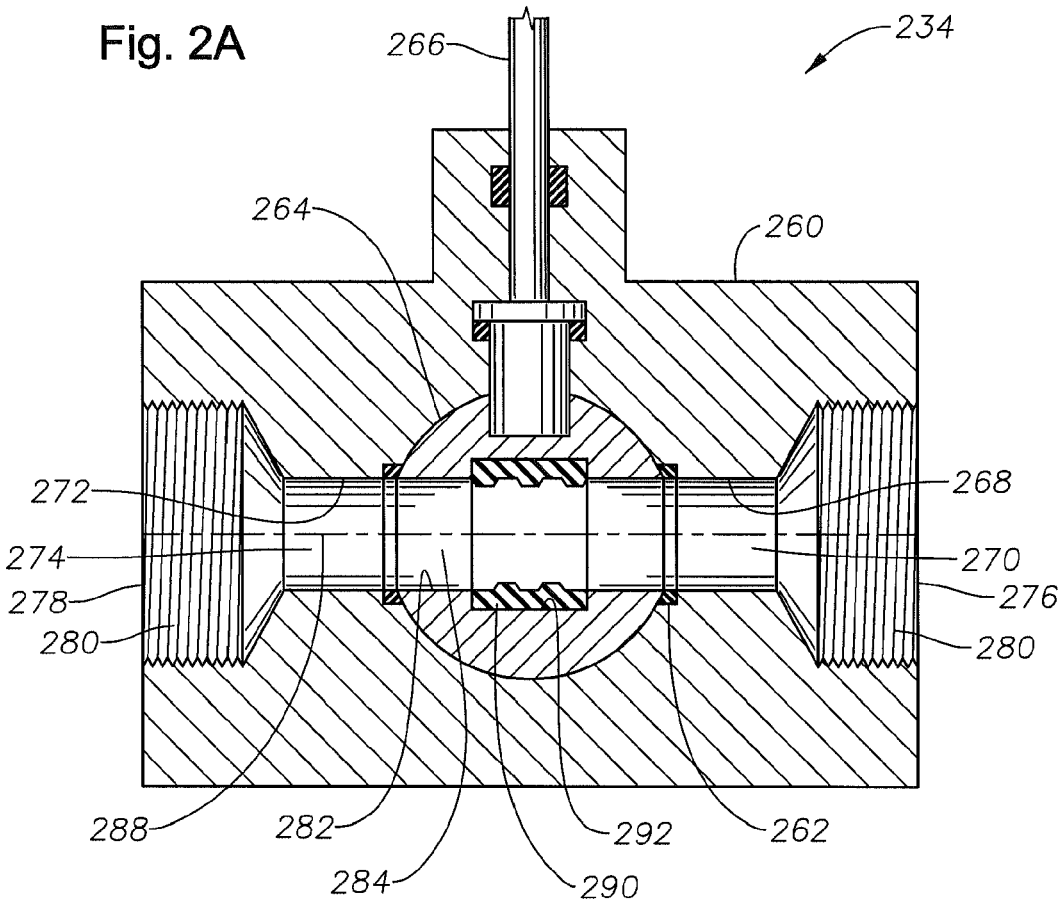
Fig. 2B
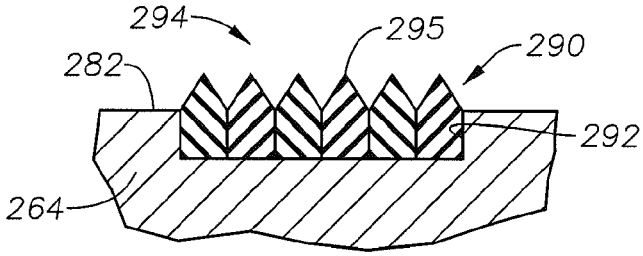
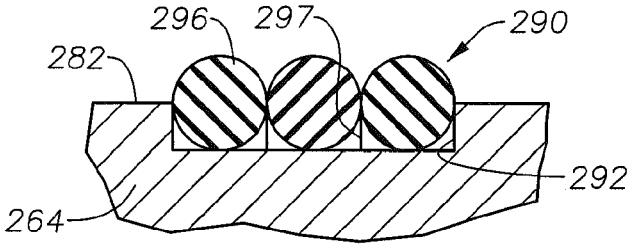
Fig. 2C

SUBMERSIBLE PUMP SYSTEMS AND METHODS

CROSS-REFERENCE TO RELATED PATENT APPLICATIONS

This application claims priority from U.S. Provisional Application No. 61/635,954, filed Apr. 20, 2012. For purposes of United States patent practice, this application incorporates the contents of the Provisional Application by reference in its entirety.

BACKGROUND OF THE INVENTION

1. Field of the Invention

The field of invention relates to a submersible pump system and a method its use. More specifically, the field of invention relates to a system for and a method of accessing a well bore production zone while the system is in use.

2. Description of the Related Art

One method of producing hydrocarbon fluid from a well bore that lacks sufficient internal pressure for natural production is to utilize a submersible pumping device. A string of tubing or pipe known as a production string suspends the submersible pumping device near the bottom of the well bore proximate to the producing formation. The submersible pumping device is operable to retrieve production zone fluid, impart a higher pressure into the fluid and discharge the pressurized production zone fluid into production tubing. Pressurized well bore fluid rises towards the surface motivated by difference in pressure.

A submersible pump system is installed during completion operations in a specifically designed well bore production zone. The production zone is a portion of the well bore in-between or below a packer or plug where hydrocarbons are produced for production. The packers and plugs isolate the portion of the well bore that is in fluid communication with the hydrocarbon-bearing formation from the remainder of the well bore. Fluid isolation of the production zone permits access, maintenance and even fluid isolation of the remainder of the well bore without disturbing the production zone.

Accessing the production zone for maintenance or information gathering after installing plugs or packers is typically avoided because it is expensive, time consuming and a technically challenging endeavor. Reasons for accessing the production zone include making additional production perforations in the well bore casing, treating the hydrocarbon-bearing formation with chemicals to alter its production profile, including applying acid treatments or removing scale, and performing routine and specialized production logging with coiled tubing or wire line tools, including identifying zones of water and oil.

Known techniques for using a submersible pump system while also accessing the production zone create significant operational problems. Although installing a submersible pumping device in a production zone is relatively easy, accessing the production zone through the submersible pumping device is difficult if not impossible. Submersible pumping devices do not provide direct mechanical access into the production zone from the production tubing string because the pump obstructs access except for fluids passing via the pump impellers.

A Y-tool can offer access through a submersible pump system. The Y-tool requires the use of a "blank plug" while the submersible pumping device is in use to access the production zone. A blank plug set in the bypass pathway prohibits fluid from recycling from the submersible pumping device discharge back into the well bore through the bypass branch of the Y-tool. Wire line operations for setting and removing blank plugs are expensive, pose operational and personnel safety concerns and usually results in deferred production.

A Y-tool with an internal flapper or diverter, sometimes called an "auto Y-tool", poses significant downtime risk if it mechanically fails. Manufacturers do not design auto Y-tools for removal during service, so if a mechanical problems with the flapper represent catastrophic failure of the device and a system-wide issue. Repair or replacement of the auto Y-tool requires installation of a work over rig and removal of the entire production tubing string. A replacement operation can take from 10 to 30 days to plan and execute, resulting in costly downtime. In addition, auto Y-tools require that the operator turn the submersible pumping device on and off to manipulate the flapper position for accessing the production zone. Repeated use can lead to wear and tear on both pump and flapper device, shortening its operational life span.

SUMMARY OF THE INVENTION

A submersible pump system that is operable to permit selective access into a production zone of a well bore while a submersible pumping device is operating includes a Y-tool, a submersible pumping device, a control valve assembly and a power conduit. The Y-tool has a production tubing branch, a submersible pump branch and a bypass branch. The submersible pumping device couples to the Y-tool and is in fluid communication with the Y-tool through the submersible pump branch. The submersible pumping device is operable to receive a pre-designated pump control signal. The control valve assembly couples to the Y-tool and is in fluid communication with the Y-tool through the bypass branch. The control valve assembly comprises a valve. The control valve assembly is operable to receive a pre-designated valve control signal. The control valve assembly is also operable to selectively permit access between the interior of the submersible pumping system and the exterior of the submersible pumping system. The valve of the control valve assembly comprises a valve disk and a valve bore wall. The valve bore wall defines a valve bore. The power conduit couples to both the submersible pumping device and the control valve assembly. The power conduit is in communication with both the submersible pumping device and the control valve assembly. The power conduit is operable to convey both power and a pre-designated control signal simultaneously.

A method for accessing the production zone of the well bore with a well bore tool uses the submersible pump system while the submersible pump system is producing production zone fluid. The well bore tool is configured to traverse through the submersible pump system. The production zone is a fluidly isolated portion of the well bore, and it contains the production zone fluid produced by the submersible pump system. The method includes introducing the submersible pump system into the well bore such that the submersible pump system is located in the production zone. The method also includes the step of transmitting through the power conduit a pre-designated pump control signal such that the submersible pumping device operates to produce the production zone fluid. The method also includes the step of introducing into the submersible pump system the well bore tool such that the well bore tool traverses through the bypass branch of the Y-tool. The method also includes the step of transmitting through the power conduit a pre-designated valve control signal such that the control valve assembly operates to permit access to the production zone through the control valve assembly valve. The method also includes the step of introducing the well bore tool into the production zone such that the well bore tool traverses through the control valve assembly. A dynamic seal forms between the well bore tool and the valve of the control valve assembly during the well bore tool introduction. The submersible pumping device continues to operate without interruption after transmission of the predesignated pump control signal.

The submersible pump system permits access to the production zone regardless of the operating state of the submersible pumping device, unlike other prior art devices. The position of the control valve assembly is independent of the operation of the submersible pumping device.

BRIEF DESCRIPTION OF THE DRAWINGS

These and other features, aspects, and advantages of the present invention are better understood with regard to the following Detailed Description of the Preferred Embodiments, appended Claims, and accompanying FIGS., where:

FIGS. 2A-C are partial drawings of a useful valve for an embodiment of the submersible pump system.

FIGS. 1-3 and their associated descriptions facilitate a better understanding of the submersible pump system and its method of use. In no way should the FIGS. limit or define the scope of the invention. The FIGS. are simplified diagrams for ease of description.

DETAILED DESCRIPTION OF THE PREFERRED EMBODIMENTS

Figure 1:
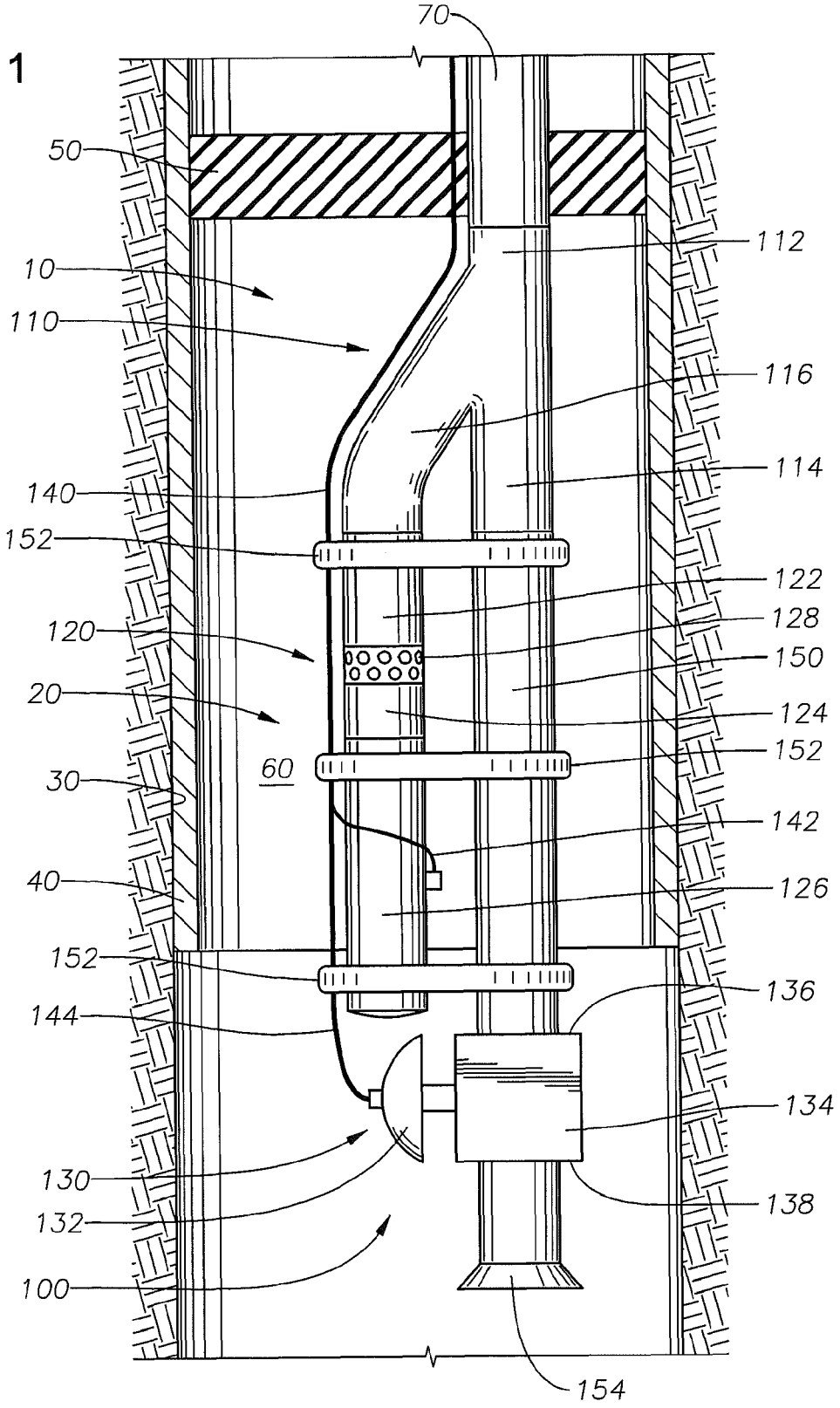
FIG. 1 is a drawing of an embodiment of the submersible pump system in the production zone of the well bore.

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification. Those of skill in the art understand that the invention is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the at to which this invention belongs unless defined otherwise.

As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non joined objects. If a first device couples to a second device, the connection can occur either directly or through a common connector. "Operable" and its various forms means fit for its proper functioning and able to be used for its intended use. "Associated" and its various forms means something connected with something else because they occur together or that one produces the other.

Spatial terms describe the relative position of an object or a group of objects relative to another object or group of objects. The spatial relationships apply along vertical and horizontal axes. Orientation and relational words including "uphole" and "downhole"; "above" and "below"; "up" and "down" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The invention encompasses and bounds smaller ranges of the interval subject to any specific exclusion provided.

When a patent or a publication is referenced in this disclosure, the reference is incorporated by reference and in its entirety to the extent that it does not contradict statements made in this disclosure.

Where the Specification and appended Claims reference a method comprising two or more defined steps, the defined steps can be carried out in any order or simultaneously except where the context excludes that possibility.

Submersible Pump Systems

The submersible pump system includes the Y-tool, the submersible pumping device, the control valve assembly and the power conduit. The submersible pump device and the control valve assembly couple to the Y-tool. The power conduit is in communication with both the submersible pump device and the control valve assembly simultaneously. The submersible pump system is operable to selectively permit access to the production zone of the well bore through the control valve assembly.

Aspects of the submersible pump systems are best understood in reference to their use in the well bore. A method of using the submersible pump system includes introducing the submersible pump system into the well bore such that the submersible pump system is located in the production zone of the well bore. The production zone is fluidly isolated from the remainder of the well bore by well-known means, including packers and plugs. The submersible pump system operates within the confines of the production zone.

FIG. 1 is a drawing of an embodiment of the submersible pump system in the production zone of the well bore. Well bore 10 includes production zone 20, which is fluidly isolated from the remainder of well bore 10. Well bore wall 30 bounds and defines the outer bounds of well bore 10. Casing 40 clads a portion of well bore wall 30 in production zone 20. The remaining portion of well bore wall 30 is exposed for production purposes. Well plug 50, which fluidly isolates production zone 20 from the remainder of the well bore 10, acts as a boundary for the top of the production zone 20. Production zone 20 contains production zone fluid 60, which includes some hydrocarbons from the hydrocarbon-bearing formation, for production to the surface (not shown). Production tubing string 70 is the main fluid conduit that is operable to convey production zone fluid 60 to the surface. Production tubing string 70 passes downward from the surface through well plug 50 into production zone 20. Production tubes include thin-walled drill pipe, specially designed casing and coiled tubing. Production tube 50 contacts well plug 50 such that production zone 20 maintains fluid isolation from the remainder of well bore 10.

FIG. 1 also shows submersible pump system 100, which includes Y-tool 110, submersible pumping device 120, control valve assembly 130 and power conduit 140.

Y-tool

The submersible pump system uses the Y-tool to combine two fluid production pathways downhole into a single production tubing string uphole of the Y-tool. As shown in FIG. 1, Y-tool 110 possesses three connected internal fluid flow pathways: a production tubing pathway, defined by production tubing branch 112, a bypass pathway, defined by bypass branch 114, and a pump pathway, defined by pump branch 116. The Y-tool permits mechanical connection to and fluid communication with other parts of the submersible pump system. The bypass pathway and the production tubing pathway are in concentric or vertical alignment such that appropriately sized mechanical tools can pass directly into the production zone through the submersible pump system from the production tubing string. The pump pathway is at an angle from the bypass pathway. The submersible pumping device blocks the pump pathway from being a mechanical access to the production zone.

As shown in FIG. 1, Y-tool 110 has production tubing branch 112, bypass branch 114 and pump branch 116. Y-tool 110 mechanically couples to production tubing 70 such that Y-tool 110 forms part of the fluid conduit from the production zone 20 to the surface (not shown). Production tubing branch 112 and bypass branch 114 are in vertical alignment. Pump branch 116 extends in a diagonally lateral direction from the production tubing branch 112.

Useful Y-tools for the submersible pump system do not use a mechanical flapper to control flow direction.

Submersible Pumping Device

Submersible pump system couples the submersible pump device to the Y-tool through the pump branch. Submersible pump device draws production zone fluid through fluid inlets and discharges the pressurized production zone fluid towards the surface through the production string. Submersible pumping device pressurizes the production zone fluid to a pressure greater than the pressure of the fluid in the production zone to overcome the fluid head pressure in the production string.

The submersible pumping device has a number of components, including a pump with fluid intakes, a mechanical seal and a pump motor. Each pump has a number of stages mounted in series, each stage having an impeller and a diffuser. The seal couples the motor to the pump. An internal housing contains all of the parts of the submersible pumping device to protect the parts from production zone fluid intrusion and abrasive damage.

FIG. 1 shows submersible pumping device 120 connected to and in fluid communication with Y-tool 110 through pump branch 116. Submersible pumping device 120 has a number of components, including pump 122, seal 124, motor 126 and fluid intakes 128. Seal 124 couples motor 126 to pump 122. Pump 122 draws production zone fluid 60 into the inlet of pump 122 through fluid intakes 128. Pressurized production zone fluid flows through pump branch 116, into production tubing branch 112 and through production tubing 70 towards the surface.

FIG. 1 shows power conduit 140 coupled to motor 126. An embodiment of the submersible pump system uses hydraulic power to drive the pumping action. An embodiment of the submersible pump system uses electrical power. The motor is operable to receive pre-designated pump control signals through the power conduit and to response in a manner associated with the received pre-designated pump control signals.

Control Valve Assembly

The control valve assembly is operable to selectively permit access to the production zone. The control valve assembly includes an actuator that couples to a valve. The actuator is operable to receive a pre-designated valve control signal through the power conduit and to operating in a manner associated with the received pre-designated valve control signal. The actuator is operable to manipulate the position of the valve. The valve is operable for full-range selective positioning, including "fully open" and "fully closed". The fully open position permits access through the submersible pump system to the production zone such that both fluids and tools configured to pass through the submersible pump systems can traverse the control valve assembly. The fully closed position does not allow fluid or mechanical access to the production zone through the submersible pump system.

FIG. 1 shows control valve assembly 130 coupled to and in fluid communication with bypass branch 112 of Y-tool 110. Control valve assembly 130 regulates access to production zone 20 through submersible pump system 100 by selective positioning valve 134. Control valve assembly 130 includes actuator 132 coupled to valve 134. Valve 134 couples with and is in fluid communication with Y-tool 110 on uphole side 136. Downhole side 138 of valve 134 is in fluid communication with production zone 20.

Control Valve Assembly Valve

Useful valve types include gate, globe, angle, diaphragm, plug, cock, ball and butterfly valves. Ball valves are reliable; provide quarter-turn operation to position the valve open or closed and have valve disk bores that can be adapted to retain an internal seal assembly. The value couples to the other components of the submersible pump system through known means for connecting fluid conduits, including pipe threads, flanges, butt-welding and chemical adhesives.

Valve body configurations that avoid removal of the submersible pump system for servicing the valve internals are useful as part of the submersible pump system. Useful valve body types permit remote maintenance of the internal components of the valve while the body remains installed and in situ. Valve body types include single, three-piece, split, top-entry, side-entry and welded bodies. Useful valve body types include three-piece bodies and side-entry ports, which permit the removal of internal operating parts, including the entire midsection of the valve, using known wire line tools and techniques.

The control valve assembly valve is operable to form a dynamic seal with a well bore tool configured to pass through the control valve assembly. Well bore tools include coiled tubing, carbon rods, plugs and logging while pumping (LWP) instruments. A "dynamic" seal forms between a moving object and a stationary objects; a "static" seal forms between two non-moving objects. Just like the static seal, the dynamic seal does not permit fluids, including well bore or pressurized fluid, to pass between the objects forming the seal, that is, the valve and the well bore tool. In using the submersible pump system, the stationary object is the internal seal assembly and the moving object is the well bore tool. The dynamic seal can form from fluid surface tension between the moving and stationary objects. It can also form from frictional contact between elements of the internal seal assembly held under tension against the well bore tool as the tool passes proximate to the internal seal assembly.

In an embodiment of the submersible pump system, the valve is also operable to form a static seal with a well bore tool configured to pass through the control valve assembly. While the well bore tool is in a position that traverses the control valve assembly valve, the dynamic seal formed between the valve and the well bore tool can be maintained as a static seal upon termination of movement through the valve.

Control Valve Assembly Actuators

The actuator for the control valve assembly converts power into mechanical action, for example, rotation and elevation. The mechanical action selective positions the valve disk to a fully open, partially open or "throttled", or a fully closed position. The actuator automates the movement of the valve disk in the valve. In FIG. 1, actuator 132 couples to and manipulates the position of valve 134, which selectively permits access to the production zone 20.

FIG. 1 shows power conduit 140 coupled to actuator 132. An embodiment of the submersible pump system uses a hydraulically powered assembly actuator. An embodiment of the submersible pump system uses an electrically powered assembly actuator. The actuator is operable to receive a pre-designated valve control signal through the power conduit and is operable to selectively position the valve disk in a manner associated with the received pre-designated valve control signal. Upon receipt of the pre-designated valve control signal associated with opening the valve, the actuator manipulates the connected valve stem until the valve stem reaches a pre-designated position associated with the open position of the valve. A pre-designated valve control signal instructs the actuator to operate in a manner such that the actuator positions the value disk such that the fluid flow pathway is partially open and partially obstructed ("partially open position" or "throttled"). Another pre-designated valve control signal instructs the actuator to selectively position the valve disc such that the fluid flow pathway is fully obstructed.

When system power or communication is lost, the control valve assembly actuator automatically changes the valve disk to a pre-designated position. In some such instances, the actuator opens the valve—referred to as "fails open". In other such instances, the actuator "fails closed". Preferably, the control valve assembly actuator fails open such that upon loss of power or communications the production zone remains accessible.

Power Conduit

The submersible pump system includes a power conduit that couples the power source to the submersible pump system and is operable to convey power from the former to the latter. The power conduit connects to both the control valve assembly and the submersible pumping device and is operable to convey power to both simultaneously. In an embodiment of the submersible pump system, the power conduit is operable to convey hydraulic fluid as the energy-driving source and communications medium for the motor and the actuator. In an embodiment of the submersible pump system, the power conduit is operable to convey electrical power. The power conduit is operable to convey both power and the pre-designated control signals simultaneously. The power conduit is operable to convey both the pre-designated valve control signal and the pre-designated pump control signal simultaneously.

As shown in FIG. 1, power conduit 140 couples to both submersible pumping device 120 and control valve assembly 130. Power conduit 140 is operable to convey power and pre-designated pump command signals to motor 126 through pump conduit branch 142. Power conduit 140 is also operable to convey power and pre-designated valve command signals to actuator 132 through control valve conduit branch 144. Power conduit 140 connects to a power source and a pre-designated signal transmission system at the surface (not shown).

Since dissimilar operating equipment—pump motors and valve actuators—are drawing power and receiving pre-designated control signals through a common signal and power conduit, the submersible pump system is operable to ensure that the pre-designated control signals for one unit does not interfere with the operation of another unit.

In using the submersible pump system, the pre-designated control signals for each unit can take different forms depending on the power used. For an electrically powered system, pre-designated control signals transmitted at a distinct frequency greater than that of the frequency of the power conveyed will not negatively interfere with the conveyance or use of the power in the units (that is, circuits, motor coils). Transmitting two different pre-designated control signals—one for the valve and one for the pump—at distinct and elevated frequencies through the power conduit permits simultaneous communication as well as continuous power supply during signal transmissions. If three-phase electrical power is used, the pre-designated pump control signals can be conveyed along one of the three-phase lines and the pre-determined valve control signals can be conveyed along a second line. Such a split-line power conduit communication means, where the motor and the actuator are only operable to receive commands from one of the three-phase lines, enhances reliability as the pre-designated command signals for a particular units only come from one line and not the two others. For hydraulic power, pre-designated control signals can take the form of audible tones or distinct patterns transmitted sonically through the hydraulic fluid. The tonal frequencies or rhythmic patterns do not affect either the supply pressure or flow rate of the hydraulic fluid. The motor and actuator can interpret the pre-designated command signals from background noise by seeking certain tonal frequencies or patterns, or combinations of both, above background signal interference. Those of ordinary skill in the art understand various other means and methods for transmission of a pre-designated control signal through either electrical or hydraulic power systems.

In FIG. 1, submersible pumping device 120 extends generally parallel with bypass tubing 150. Several clamps 152 secure submersible pumping device 120 to bypass tubing 150 for stability. Bypass tubing 150 fluidly and mechanically couples control valve assembly 130 and Y-tool 110. Production zone 20 is selectively fluidly accessible from the surface through bypass inlet 154. When valve 134 is open, fluid and mechanical access to the production zone 20 is available through the fluid pathway formed through production tubing 70, Y-tool 110, bypass tubing 150, valve 134 of control valve assembly 130 and bypass inlet 154.

Control Valve Assembly Valve Internals

FIG. 2A shows a partial view of valve 234, which is useful as part of the submersible pump system. Valve 234 includes valve body 260, valve seals 262 and valve disk 264, which couples to valve stem 266. Uphole valve bore wall 268 defines uphole valve bore 270, and downhole valve bore wall 272 defines downhole valve bore 274. Valve body 260 includes uphole valve port 276 and downhole valve port 278, each shown as having pipe threads 280 for mechanical coupling. Valve disk 264 has disk bore wall 282, which defines disk bore 284.

The control valve assembly is operable to selectively permit access to the production zone by positioning the valve disk such that the fluid flow pathway is generally unobstructed to mechanical devices configured to traverse the submersible pump system. Useful valves have a valve disk with a disk bore wall that defines a disk bore. When the valve having a disk bore wall is in an open position the disk bore wall aligns with the valve bore wall, which aligns the disk bore with the valve bore, and forms a fluid flow pathway through the valve. For the submersible pump system, the open valve forms a portion of the fluid flow pathway between the production zone and the surface.

Useful valves do not permit access to the production zone when the valve is in the closed position. In closed valves having a disk bore, the disk bore is not in alignment with the valve bore. This non-alignment disrupts the fluid flow pathway. Neither fluid nor tools are able to traverse from the uphole to the downhole sides of the closed valve. With ball valves, the centerline of the disk bore in the closed position is perpendicular to the centerline of the uphole and downhole valve bores.

FIGS. 2A-C are partial drawings of a useful valve for an embodiment of the submersible pump system. FIG. 2A shows valve 234 in the open position. Disk bore 284 is in alignment with both uphole valve bore 270 and downhole valve bore 274. When open, fluid and tools adapted to pass through valve 234 can enter uphole valve port 276; traverse through uphole valve bore 270, disk bore 284 and downhole valve bore 274; and egress using downhole valve port 278. Valve bore centerline 288 aligns with uphole valve bore 270, disk bore 284 and downhole valve bore 274. Although not shown in FIG. 2A, if the valve is in the closed position then disk bore 284 would not in be in alignment with valve bores 270 and 274.

Valve Internal Seal Assembly

In an embodiment of the submersible pump system, the control valve assembly valve includes an internal seal assembly. In such an embodiment, the internal seal assembly is operable to form the dynamic seal with the well bore tool configured to pass through the submersible pump system.

In many situations where a dynamic seal forms between the internal seal assembly and the well bore tool, the internal seal assembly facilitates the transition of the formed dynamic seal into the static seal when the introduced well bore tool halts its motion relative to the internal seal assembly. In addition in such an embodiment, the internal seal assembly also facilitates the reformation of the dynamic seal from the static seal upon reintroduction of relative motion between the two seal members.

As part of an embodiment of the submersible pump system, the internal seal assembly is operable to form a dynamic seal on a well bore tool with an outer diameter proximate to the inner diameter of the valve bore or the diameter of the disk bore depending on the physical location of the internal seal assembly. For example, for a 9.625" diameter casing well, the bypass tubing can have a nominal size of about 2.875". If the internal diameter of the valve bore and the bypass tubing matches to provide full-bore access, the size of well bore tools that can traverse the valve bore are 2.375" in breadth or smaller. Therefore, the internal seal assembly is operable to fit 2.375" breadth or less well bore tools. In another example, a 7" diameter casing well has bypass tubing up to about 2.375" nominal diameter. Assuming that the internal diameter of the valve bore and the bypass tubing match, the internal seal assembly is operable to support well bore tools having a breadth of about 2" or less.

Positioning an internal seal assembly along the disk bore wall, especially in a ball valve, physically isolates the internal seal assembly from external debris, sediment and potential damage when the valve is closed. For the valve shown in FIG. 2A, internal seal assembly 290 is along disk bore wall 282. Recessed channel 292 circumferentially traverses disk bore 284, which houses internal seal assembly 290.

FIG. 2B shows an example of an internal seal assembly using a set of flexible fin rings 294 in recessed channel 292. Flexible fin rings 294 have fin tips 295 that when in frictional contact with the moving object yield in the direction of travel of the contacting, moving object. Flexible fin rings 294 are resilient such that they stay in frictional contact with the moving object, thereby forming and maintaining the dynamic seal between the internal seal assembly and the moving object. The dynamic seal can form a static seal between the once-moving object and the internal seal assembly of FIG. 2B through contact of the formerly moving object with fin tips 295.

FIG. 2C shows another example of an internal seal assembly. In recessed channel 292, oversized O-rings 296 in retaining brackets 297 provide rounded dynamic sealing edges. One of ordinary skill in the art recognizes the variety of internal seal assembly shapes and configurations that can form a dynamic seal between an introduced, moving object and the internal seal assembly of the control valve assembly.

In an embodiment of the submersible pump assembly, the internal seal assembly is located along one of the valve bores in a recess formed along the valve bore wall. In an embodiment, the internal seal assembly is positioned uphole of the valve disk. An advantage to locating the internal seal assembly along the valve bore wall includes the ability to position a well bore tool relative to the internal seal assembly such that a static seal forms between the tool and the internal seal assembly before placing the valve disk in the open position. Forming a dynamic seal that converts into a static seal between the internal seal assembly and the well bore tool before opening the control valve assembly prevents fluid loss and flow recycle while the submersible pumping device continues operations uninterrupted.

In an embodiment of the submersible pump system, the valve has more than one internal seal assembly. In some such embodiments, each internal seal assembly can have a different physical configuration for forming a variety of dynamic and static seals with different sized and shaped well bore tools and under various operating situations. For example, a valve with two internal seal assemblies can have a first internal seal assembly positioned along the uphole valve bore wall and a second internal seal assembly positioned along the disk bore wall of the disk bore. Depending on the configuration of the internal seal assemblies, the valve structure and the well bore tool with which the dynamic seal forms, one or both internal seal assemblies can form dynamic seals upon introduction of the well bore tool. One of ordinary skill in the art recognizes the variety of valve bore wall and disk bore wall internal seal assembly shapes and configurations that can form singular or multiple dynamic seals between the internal seal assemblies and a moving, introduce well bore tool.

Materials useful for forming internal seal assemblies include polymers that have elastomeric qualities as well as polymers with plastomeric properties that do not permanently distort upon forming a static or dynamic seal. Useful materials are operable to withstand the solvating effects of the hydrocarbon-rich environment, elevated temperatures (greater than 150° F.) and prolonged periods of non-use in the production zone. Useful materials include those that have a reduced coefficient of friction against metal surfaces, including ferrous-, copper-, aluminum- and titanium-based alloys, such that the moving object can easily pass along its surface if physical contact is made. Materials that can provide the desirable chemical, temperature, surface friction and elastomeric service qualities, used either signally or in combination to form elements of or the entire internal seal assembly, include halogenated polymers, including chloropolymers and fluoropolymers. Useful plastomers include polytetrafluoroethylene (PTFE), perfluoroalkoxy polymers (PFA, MFA), polychlorotrifluoroethylene (PCTFE), polyvinylidenefluoride (PVDF), polyether ether ketone (PEEK, PEK, PEKK) polymers, fluorinated ethylene-propylene polymers (FEP), polyetherimides (PEI), ethylene-tetrafluoroethylene (ETFE) copolymers, ethylene-chlorotrifluoroethylene copolymers (ECTFE); silicone materials; and fluoroelastomers.

Fluoroelastomers suitable for forming elastomeric elements of internal seal assemblies include fluoroelastomer polymers listed in ASTM D 1418, titled "Standard Practice for Rubber and Rubber Latices—Nomenclature", under the classes "FKM", "FFKM" and "FEPM". FKM elastomers are fluoro-rubbers of the polymethylene type that utilizes vinylidene fluoride as a comonomer and have substituent fluoro, alkyl, perfluoroalkyl or perfluoroalkoxy groups in the polymer chain, with or without a cure site monomer. ASTM D 1418 lists five types of FKM-class elastomers:

Type 1: Copolymers of hexafluoropropylene (HFP) and vinylidene fluoride (VDF);

Type 2: Terpolymers of tetrafluoroethylene (TFE), HFP and VDF;

Type 3: Terpolymers of TFE, VDF, and a fluorinated vinyl ether including perfluoromethylvinylether (PMVE);

Type 4: Terpolymers comprised of propylene, TFE and VDF; and

Type 5: Pentapolymers comprised of TFE, HFP, ethylene, a fluorinated vinyl ether and VDF.

FFKM elastomers are perfluoroelastomeric materials. FFKM polymers are perfluoro rubbers of the polymethylene type having all substituent groups on the polymer chain either fluoro, perfluoroalkyl, or perfluoroalkoxy groups. FFKM elastomers are typically based on the monomers TFE and PMVE and can be said to be "rubberized PTFE". FEPM are tetrafluoro ethylene/propylene rubbers that are fluoro rubbers of the polymethylene-type containing one or more of the monomeric alkyl, perfluoroalkyl, perfluoroalkoxy groups with or without a cure site monomer. Example FEPMs include copolymers of propylene and TFE and terpolymers of propylene, TFE and PMVE.

Method for Accessing a Production Zone of a Well Bore

A method for accessing the production zone of the well bore with the well bore tool using the submersible pump system while the submersible pump system is producing the production zone fluid includes introducing the submersible pump system to the well bore such that the submersible pump system is located in the production zone. The production zone is fluidly isolated from the remainder of the well bore and contains the production zone fluid. The method also includes the step of operating the submersible pump system such that production zone fluid is produced to the surface through the submersible pumping system. The ongoing operation of the submersible pump device is unaffected during the opening of the valve and the movement of the well bore tool through the control valve assembly and into the production zone.

The method features accessing the production zone with the well bore tool. The control valve assembly includes at least one internal seal assembly that is operable to form a dynamic seal with a well bore tool configured for passing through the submersible pump system. The dynamic seal forms between the valve and the introduced well bore tool. The dynamic seal prevents fluid recycle of the discharge from the submersible pumping device back into the well bore through the bypass pathway.

Figures 3A, 3B, 3C, 3D:
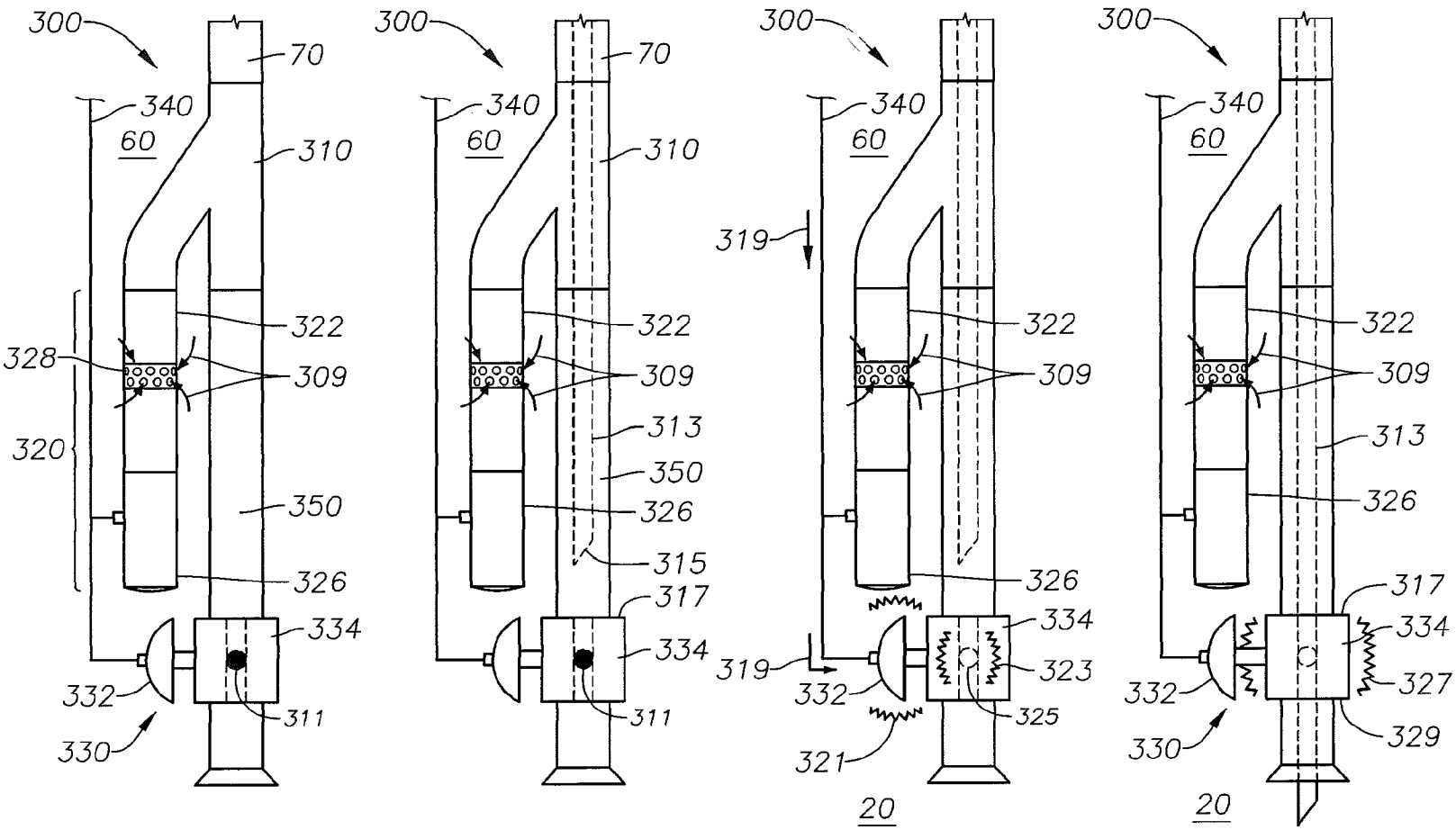
FIGS. 3A-D are drawings showing the use of an embodiment of the submersible pump system for accessing the production zone of the well bore while the submersible pumping device is operating.

FIG. 3A shows an embodiment of the submersible pump system that has been previously introduced into the production zone of the well bore and is operating the submersible pumping device such that the production zone fluid is being produced to the surface. Submersible pump system 300 has Y-tool 310 connected to production tubing string 70. Submersible pumping device 320, connected to Y-tool 310, draws in production zone fluid 60 (action 309) using fluid intakes 328. The pressurized production zone fluid flows through Y-tool 310 into production tubing string 70 towards the surface. Y-tool 310 couples to control valve assembly 330 through bypass tubing 350. Control valve assembly 330 has actuator 332 and valve 334. Control valve assembly 330 is operable to receive pre-designated valve control signals at actuator 332. Control valve assembly 330 is operable to selectively permit access to the production zone through valve 334. Valve 334 is closed (black circle 311), preventing fluid recycle while submersible pumping device 320 is operating. Motor 326 and actuator 332 both couple to and receive power through power conduit 340.

Introduction of the well bore tool configured to pass through the submersible pump system to access the production zone causes it to traverse through the production string, the production branch and the bypass branch of Y-tool. FIG. 3B shows well bore tool 313 introduced into submersible pump system 300. Well bore tool 313 passes through Y-tool 310, production tubing string 70, and bypass tubing 350 such that lead tip 315 is proximate to uphole side 317.

Positioning the downhole or leading edge of the well bore tool in close proximity to the control valve assembly valve while avoiding damage to the valve disk can have certain operational advantages. When the valve opens and permits access to the production zone, introduction of the well bore tool into the production zone can occur with minimal delay. Reducing the amount of time between opening the valve and introducing the well bore tool into the production zone minimizes the amount of recycle that may occur while the valve is open. Resting or landing the downhole end of the well bore tool on the valve disk can confirm position of the tool without causing irreparable harm to the valve disk.

In an embodiment of the method where the control valve assembly includes a valve with an internal seal assembly along the valve bore wall on the uphole side of the valve disk, positioning the well bore tool with the uphole-side internal seal assembly can form a dynamic seal upon introduction and then a static seal upon manipulation of the well bore tool. The static seal formation can occur before opening the valve to access the production zone, which can effectively eliminate pump recycle when accessing the well bore.

Transmitting a pre-designated valve control signal through the power conduit causes the submersible pump system to permit access to the production zone by opening the control valve assembly valve. FIG. 3C shows power conduit 340 conveying a transmitted pre-designated valve control signal (arrow 319) to open valve 334 from the surface to the control valve assembly 330. Upon reaching actuator 332, the pre-designated valve control signal causes actuator 332 to operate (action 321) such that valve 334 opens (action 323). Valve 334 in the open position (clear circle 325) permits access to production zone 20.

Introducing the well bore tool into the production zone through the control valve assembly creates the dynamic seal between the internal seal assembly and the well bore tool. In an embodiment of the method, the dynamic seal forms in the valve disk. In an embodiment of the method, the dynamic seal forms in the valve bore. In an embodiment of the method, the dynamic seal forms in the valve bore uphole of the valve disk. In an embodiment of the method, a first dynamic seal forms in the valve disk and a second dynamic seal forms in a valve bore. FIG. 3D shows the introduction of well bore tool 313 into production zone 20 through control valve assembly 330. Well bore tool 313 traverses through valve 334. In doing so, a dynamic seal forms (action 327) between well bore tool 313 and an internal seal assembly (not shown) in valve 334. The dynamic seal prohibits any fluid from traversing between uphole side 317 and downhole side 329 of valve 334 while well bore tool 313 is traversing through valve 334.

The submersible pumping device operates uninterrupted while the well bore tool accesses the production zone through the submersible pump system. In FIGS. 3A-D, motor 326 continually operates, supplied with power via power conduit 340. Pump 322 draws in production zone fluid 60 (action 309). Dynamic seal (action 327) minimizes recycle of the fluid discharged from the submersible pumping device when the valve is in the open position. The transmission of the pre-designated valve control signal (action 319) does not affect the operation of motor 326.

In an embodiment of the method for accessing the production zone, the method further comprises manipulating the introduced well bore tool such that a static seal forms. The well bore tool introduced into the production zone traverses the control valve assembly. The tool can be positioned such that the static seal forms between the well bore tool and the control valve assembly. The static seal forms proximate to the location in the control valve assembly where the dynamic seal forms when the tool is introduced into the production zone.

Methods for Producing Well Bore Fluid without Using Artificial Lift

The submersible pump systems can produce well bore fluid from the production zone without artificial lift. In instances where the well bore fluid in the production zone has sufficient formation pressure to overcome the liquid head in the production tubing string, transmission of the pre-designated pump control signal through the power conduit to stop the motor causes the pump to stop pumping production zone fluid. Transmission of the pre-designated valve control signal to open the valve causes the control valve assembly to open the valve and prevent access to the production zone. With the valve no longer hindering access to the production zone, a fluid flow pathway forms between the production zone and the surface, permitting production zone fluid production without artificial lift. The well bore fluid, driven by the formation pressure, rises to the surface. Reversing the method starts the submersible pumping device for artificial lift.

In instances when the well bore fluid in the production zone does not have sufficient pressure to produce fluid to the surface, "shutting in" the well temporarily permits adequate time for the hydrocarbon-bearing formation in fluid communication with the production zone to increase the pressure of the production zone fluid. Maintaining a shut in condition can permit adequate repressurization of the production zone fluid such that upon opening the valve the production zone fluid traverse up the production tubing string without artificial lift.

What is claimed is:

1. A submersible pump system that is operable to permit selective access into a production zone of a well bore while a submersible pumping device is operating, the submersible pump system comprising:

a Y-tool having a production tubing branch, a submersible pump branch and a bypass branch;

a submersible pumping device that couples to and is in fluid communication with the Y-tool through the submersible pump branch, where the submersible pumping device is operable to receive a pre-designated pump control signal;

a control valve assembly that couples to and is in fluid communication with the Y-tool through the bypass branch, where the control valve assembly comprises a valve, is operable to receive a pre-designated valve control signal and is operable to selectively permit access between the interior of the submersible pumping system and the exterior of the submersible pumping system, and where the valve comprises both a valve disk and a valve bore wall, where the valve bore wall defines a valve bore;

a seal assembly in the control valve assembly that dynamically seals against an outer surface of a well bore tool that selectively is inserted through the control valve assembly; and a power conduit that couples to and is in communication with both the submersible pumping device and the control valve assembly, where the power conduit is operable to convey both power and a pre-designated control signal simultaneously.

2. The submersible pump system of claim 1 where the power conduit is operable to convey electrical power.

3. The submersible pump system of claim 1 where the valve disk has a disk bore wall, where the disk bore wall defines a disk bore.

4. The submersible pump system of claim 3 where the valve is a ball valve.

5. The submersible pump system of claim 1 where the seal assembly comprises elements that project radially inward and axially flex in response to movement of the well bore tool.

6. The submersible pump system of claim 5 where the seal assembly is positioned along the valve bore wall.

7. The submersible pump system of claim 5 where the valve comprises a first internal seal assembly that is positioned along the valve bore wall and a second internal seal assembly that is positioned along the disk bore wall.

8. The submersible pump system of claim 5 where the valve is also operable to form a static seal.

9. The submersible pump system of claim 1, where the seal assembly comprises annular elastomeric elements that circumscribe an axial bore that intersects the valve assembly.

10. The submersible pump system of claim 1 where the seal assembly is positioned along a disk bore wall.

11. A method for accessing a production zone of a well bore with a well bore tool using a submersible pump system while the submersible pump system is producing a production zone fluid, the method for accessing comprising the steps of:

introducing the submersible pump system of claim 1 into the well bore such that the submersible pump system is located in the production zone;

transmitting through the power conduit a pre-designated pump control signal such that the submersible pumping device operates to produce the production zone fluid;

introducing into the submersible pump system the well bore tool such that the well bore tool traverses through the bypass branch of the Y-tool;

transmitting through the power conduit a pre-designated valve control signal such that the control valve assembly operates to permit access to the production zone through the control valve assembly valve;

introducing the well bore tool into the production zone such that the well bore tool traverses through the control valve assembly; and forming a dynamic seal between the well bore tool and the valve of the control valve assembly as the well bore tool is moved axially through the control valve assembly, where the submersible pumping device continues to operate without interruption after transmission of the pre-designated pump control signal, where the well bore tool is configured to traverse through the submersible pump system, and where the production zone is a fluidly isolated portion of the well bore and contains the production zone fluid.

12. The method of claim 11 where the transmitted pre-designated valve control signal is an electrical signal.

13. The method of claim 11 where the pre-designated valve control signal is transmitted through hydraulic fluid.

14. The method of claim 11 where the well bore tool is selected from the group consisting of coiled tubing, carbon rods, plugs and logging while pumping (LWP) instruments.

15. The method of claim 11 where the dynamic seal forms in a disk bore of the control valve assembly valve.

16. The method of claim 11 where the dynamic seal forms in the valve bore of the control valve assembly valve.

17. The method of claim 16 where the dynamic seal comprises a series of elastomeric rings disposed concentrically in the control valve assembly.

18. The method of claim 11 where the dynamic seal is a first dynamic seal that forms in a disk bore and a second dynamic seal that forms in a valve bore.

19. The method of claim 11 further comprising the step of manipulating the well bore tool traversing the control valve assembly such that a static seal forms between the well bore tool and the control valve assembly proximate to the location of the dynamic seal that forms during the introducing the well bore tool into the production zone step.

* * * * *